US009516992B2

(12) United States Patent
Dordan

(10) Patent No.: US 9,516,992 B2
(45) Date of Patent: Dec. 13, 2016

(54) MULTIPURPOSE HOUSEHOLD APPLIANCE FOR COMPLETE CLEANING AND ORGANIZING TO HELP IMPROVE THE HYGIENE OF BABY BOTTLES AND ALSO MORE DISTINCT WASHABLE ITEMS USED FOR BABIES AND TODDLERS

(71) Applicant: Lorena Dordan, Costa Mesa, CA (US)

(72) Inventor: Lorena Dordan, Costa Mesa, CA (US)

( * ) Notice: Subject to any disclaimer, the term of this patent is extended or adjusted under 35 U.S.C. 154(b) by 130 days.

(21) Appl. No.: 13/261,831

(22) PCT Filed: Dec. 7, 2012

(86) PCT No.: PCT/PE2012/000011

§ 371 (c)(1),
(2) Date: Apr. 15, 2014

(87) PCT Pub. No.: WO2014/081319

PCT Pub. Date: May 30, 2014

(65) Prior Publication Data

US 2014/0239783 A1 Aug. 28, 2014

(51) Int. Cl.

| | |
|---|---|
| ***A47L 17/00*** | (2006.01) |
| ***A47L 25/00*** | (2006.01) |
| ***A47L 15/37*** | (2006.01) |

(52) U.S. Cl.

CPC ..... *A47L 17/00* (2013.01); *A47L 25/00* (2013.01); *A47L 15/37* (2013.01); *Y10T 29/49716* (2015.01)

(58) Field of Classification Search

CPC ..... A47L 15/505; A47L 17/00; A47L 17/02
See application file for complete search history.

(56) References Cited

U.S. PATENT DOCUMENTS

| | | | | |
|---|---|---|---|---|
| 3,050,073 | A * | 8/1962 | McMillan | A47L 17/02 134/135 |
| 4,453,285 | A * | 6/1984 | van Rosberg | A46B 5/0075 15/164 |
| 5,181,285 | A * | 1/1993 | Kolada | A47J 43/24 4/657 |
| 2003/0080074 | A1* | 5/2003 | Adkins | A47L 19/02 211/41.6 |
| 2003/0146144 | A1* | 8/2003 | Votel | A47L 17/02 210/232 |
| 2004/0134866 | A1* | 7/2004 | Jerstroem | A47L 19/04 211/41.6 |
| 2005/0077195 | A1* | 4/2005 | Nall | A47L 17/02 206/216 |

(Continued)

*Primary Examiner* — Jason Ko
*Assistant Examiner* — Spencer Bell

(57) ABSTRACT

A household appliance (11) designed to assist parents in the whole process of cleaning, improving the hygiene, storing, and organizing not only feeding bottles, but more extensively a much more diverse range of washable products constantly used for babies and toddlers.

The present invention presents one or more compartments (1, 3 and 10) and accessories that will support in a much better way all steps that this type of housework involves.

Its configuration, components, characteristics and method of use will provide higher support providing the basis for a much safer, faster, and more efficient way to take care of the cleaning, and organization of many different baby and young children items simultaneously.

6 Claims, 15 Drawing Sheets

(56) References Cited

U.S. PATENT DOCUMENTS

| | | | | |
|---|---|---|---|---|
| 2005/0178412 | A1* | 8/2005 | Koch | A47L 15/505<br>134/135 |
| 2007/0125725 | A1* | 6/2007 | Kemper | A47L 19/04<br>211/41.3 |
| 2011/0179593 | A1* | 7/2011 | Albright | A47L 17/02<br>15/159.1 |

* cited by examiner

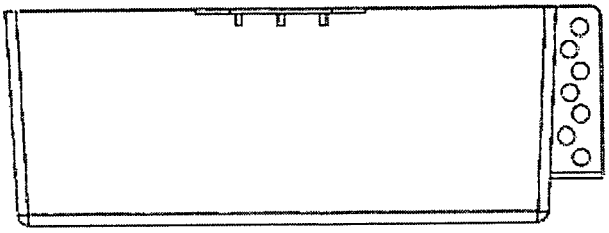
Fig. 1- A
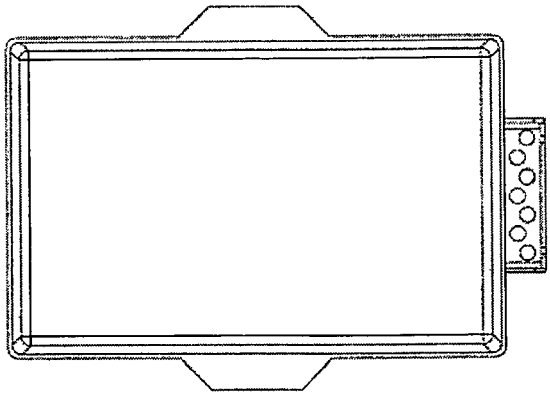
Fig. 1- B
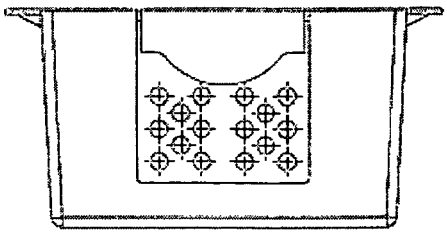
Fig. 1- C

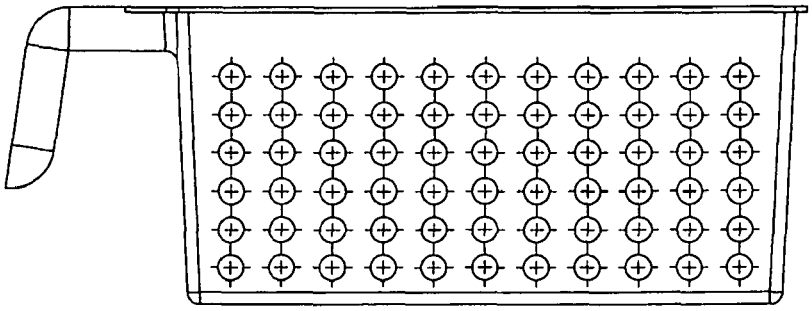
Fig. 3-A
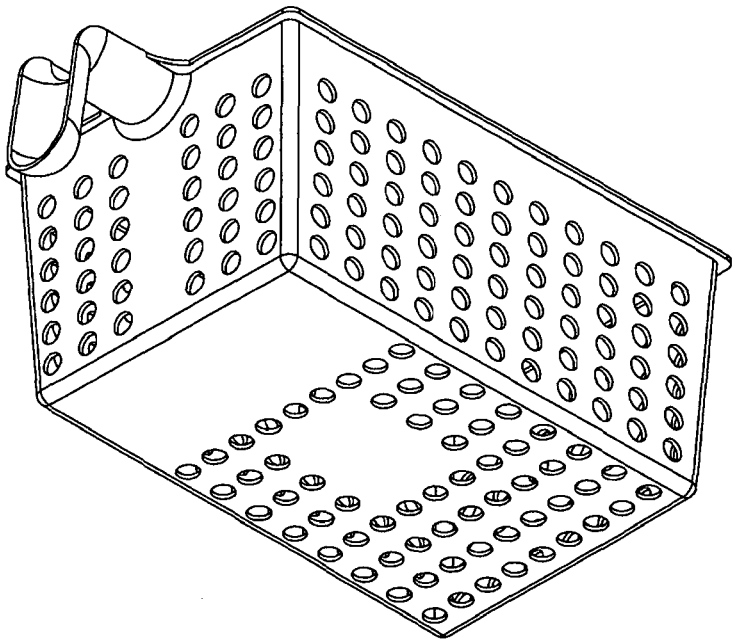
Fig. 3-B

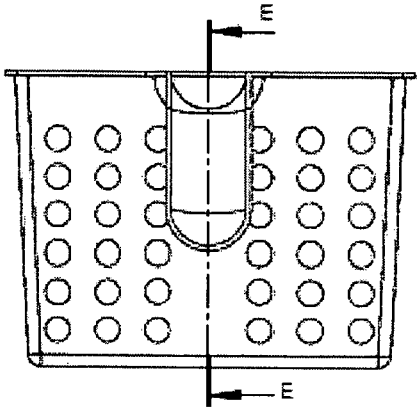
Fig。 4-A
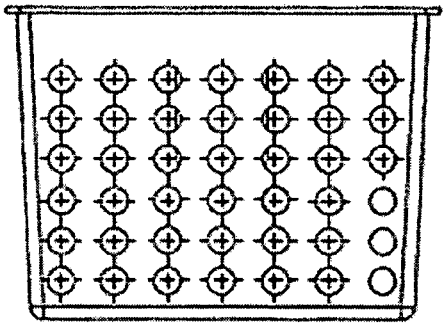
Fig。 4-B
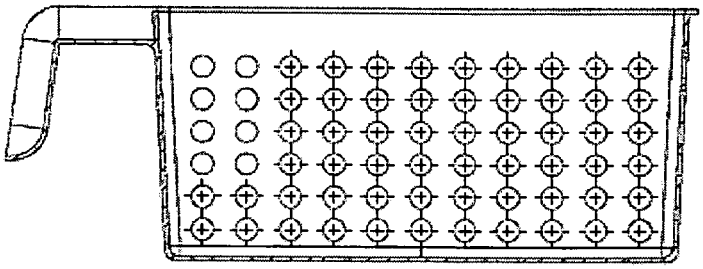
Fig。 4-C

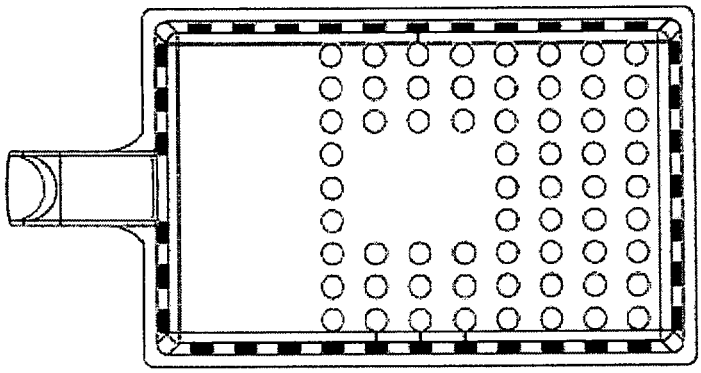
Fig. 5-A
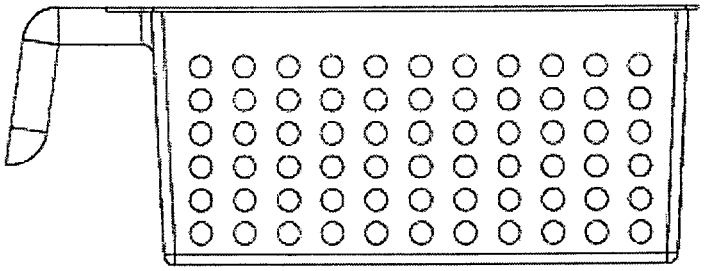
Fig. 5-B

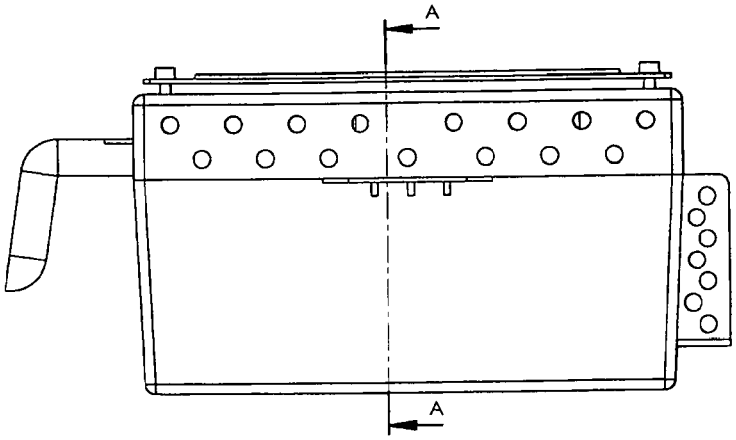
Fig. 6-A
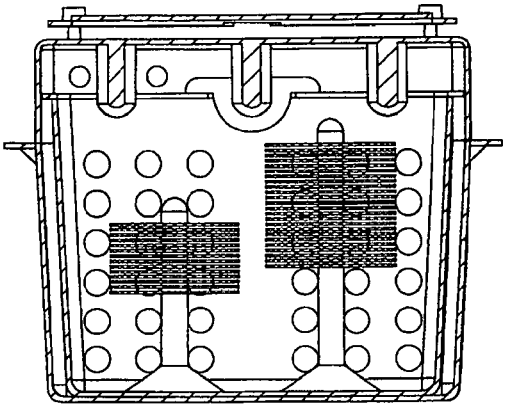
Fig. 6-B

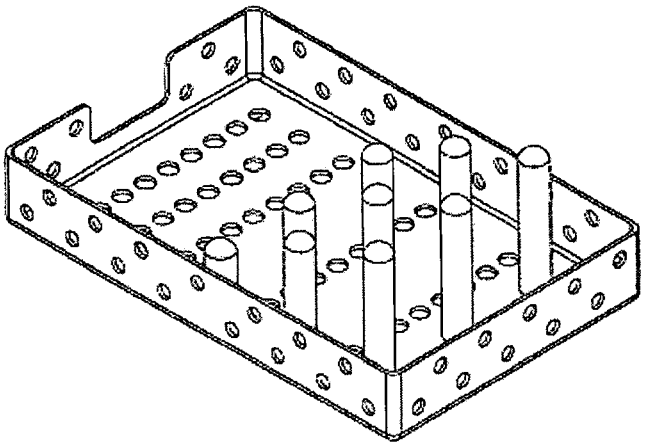
Fig. 7-A
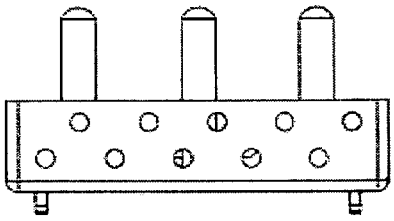
Fig. 7-B
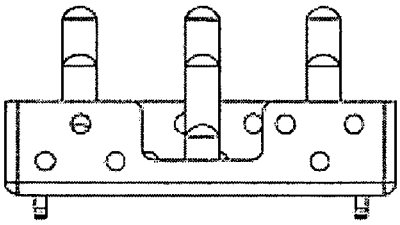
Fig. 7-C

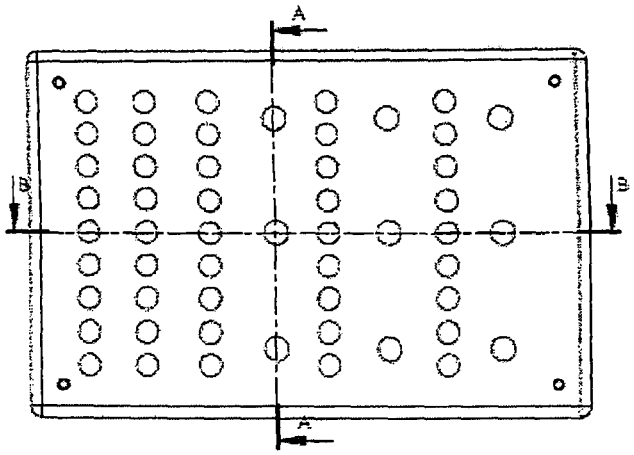
Fig. 8-A
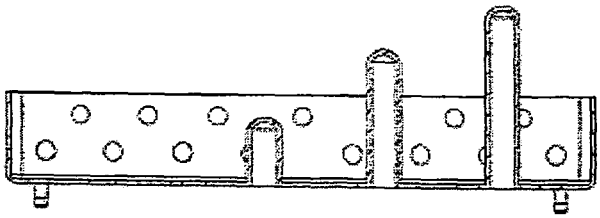
Fig. 8-B
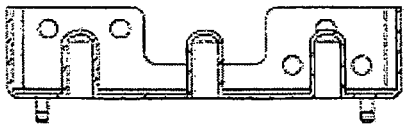
Fig. 8-C

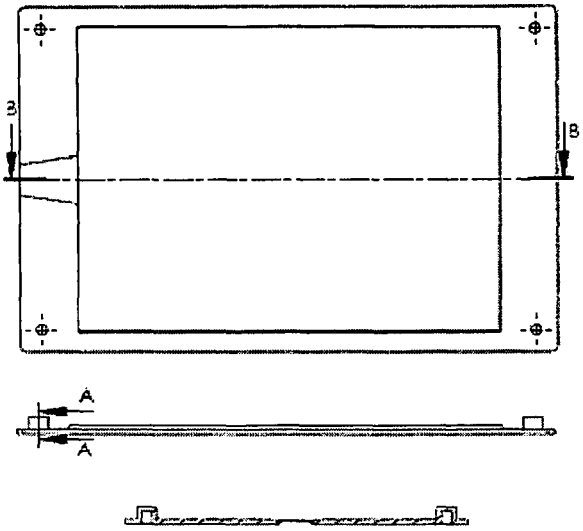
Fig. 9-A
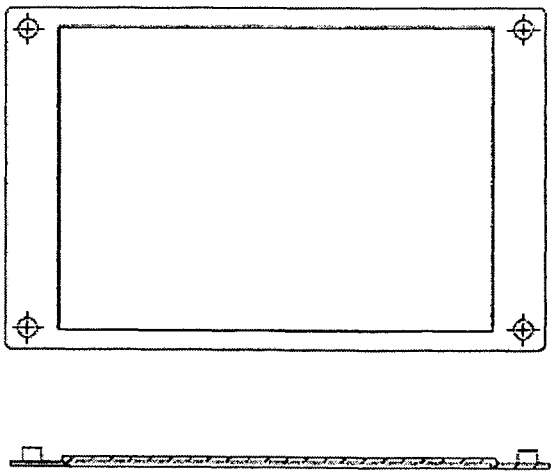
Fig. 9-B

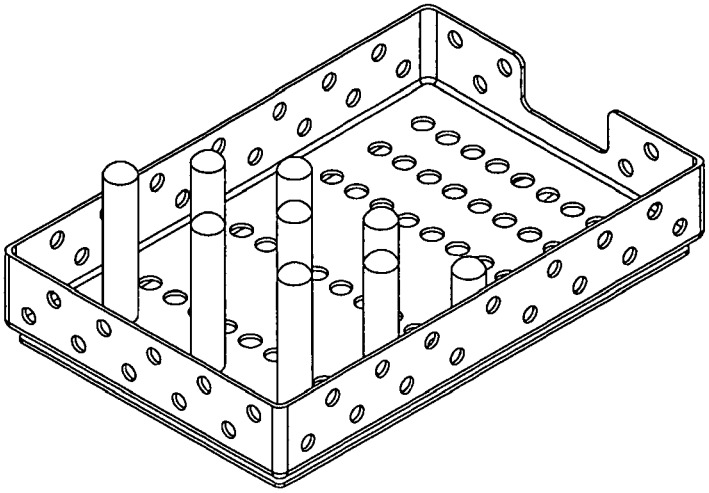
Fig. 10-A
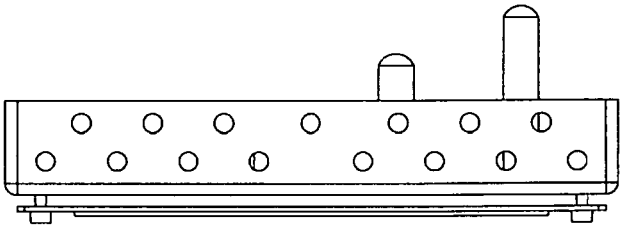
Fig. 10-B
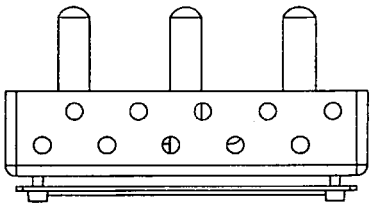
Fig. 10-C

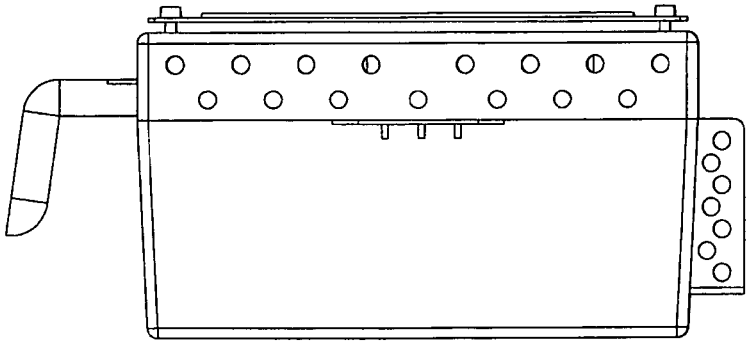
Fig. 13-A
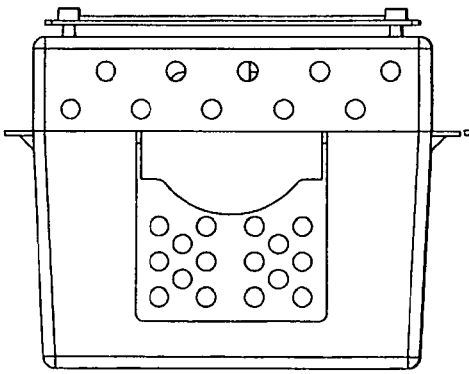
Fig. 13-B
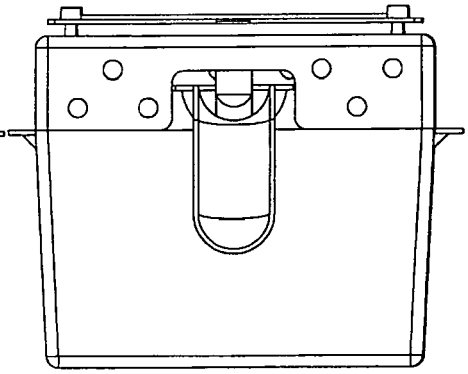
Fig. 13-C

MULTIPURPOSE HOUSEHOLD APPLIANCE FOR COMPLETE CLEANING AND ORGANIZING TO HELP IMPROVE THE HYGIENE OF BABY BOTTLES AND ALSO MORE DISTINCT WASHABLE ITEMS USED FOR BABIES AND TODDLERS

TECHNICAL FIELD

The present invention refers to a household appliance that will help a parent in the complete process of cleaning, supporting and organizing babies and toddlers washable items, containing besides the ability to work with feeding bottles and their components; the ability to receive, store, wash, scrub, rinse, drain, dry and organize a much larger and different range of infant and young children products. It is characterized by comprising one or more compartments to support each stage of task, and a synergistic connection of its components to assist the user from start to finish.

BACKGROUND

Most parents with babies and young children have to perform extra household duties; In order to fulfill these tasks many parents buy different devices as they want to implement sanitation procedures—especially in the kitchen area.

The task of cleaning (Receiving, washing, drying), organizing and storing different babies and toddlers products; such as sippy cups, feeding-bottles, forks, plates, pacifiers, teethers, lids, etc. seem easy, but in reality very complex to do and it requires time, extra care, special tools and devices to make the process smoother.

Babies' and young children's items need to have a separate space in many areas of the kitchen: inside the sink, on the countertops, or anywhere the parents want to clean and organize their products. They need a product that is easy to use, reliable, and helpful for the parent to clean and organize feeding bottles and all items used for young kids on a regular basis.

Current alternatives are designed to clean baby bottles and it's accessories/components only. In reality the parents use a much larger variety of products and accessories that also need to be cleaned, organized, and stored. Some of the main problems with the current alternatives are that 1. Individually help just one step of the many steps that this task involves 2. A parent has to buy different products separately where each product is not complemented by the other, 3. They have short capacity and limited function 4. They were created to work only for feeding bottles 5. They do not provide a unique space to store and wash several and different items at the same time 6. Dishwashers do not always clean thoroughly, therefore food and/or detergents get stuck in small baskets with limited capacity 6. All sterilizers or microwave devices are designed only for bottle use; they are difficult to clean, thus items still have the need to be washed separately.

The present invention will provide a tool specially designed to receive several items of different size, structure, and use simultaneously or independently, and it will help the parent in one or all stages of the cleaning process; To: receive, wash: scrub, rinse, drain, dry, store, and will also provide special tools such as a sponge and a multipurpose brush, to complement each stage of this job.

SUMMARY

The present invention is to provide a complete household appliance that will eliminate the drawbacks that are associated with current apparatus and devices according to the state of the art; this product will provide more capability, capacity and access to other baby and toddler items of different use, structure, and size.

It is characterized to assist on each step of the process; and will provide all the tools necessary to perform such duty successfully, as well as, narrowing the buying options down to fewer items.

The present invention provides a special configuration for receiving and transmitting these elements successively, jointly, privately, alternatively and/or simultaneously between its parts for better performance of each stage of this housework. For instance, a parent will be able to store, wash, scrub, rinse, dry and organize a zippy cup, a fork, a small plate and a feeding bottle, and its small parts simultaneously using one or more of its compartments.

BPA-free plastic it is preferred for its manufacturing, but since it's an alternative well known and largely extended in the manufacturing of several home devices, will not be necessarily limited to other safe materials for its manufacturing.

BRIEF DESCRIPTION OF THE DRAWINGS

FIG. 01: A side, top, and front view of one compartment.

FIG. 03: Another isometric view of the washer compartment.

FIG. 04: Back, front and side view of the washer compartment.

FIG. 05: Top and side view of the washer compartment.

FIG. 06: Assembled side, and an A-A section view with sample brushes.

FIG. 07: A top isometric, front, back view of the dryer compartment.

FIG. 08: A top view, section B-B, section A-A of the upper part of the dryer compartment.

FIG. 09: An upper, side and bottom view of the bottom part of the dryer compartment.

FIG. 10: An Isometric, side, front view of the dryer compartment assembled; with the upper and bottom parts.

FIG. 13: Side, front and rear view of the assembled multipurpose appliance.

DETAIL DESCRIPTION OF PRESENTLY PREFERRED EMBODIMENTS

Figure 2:
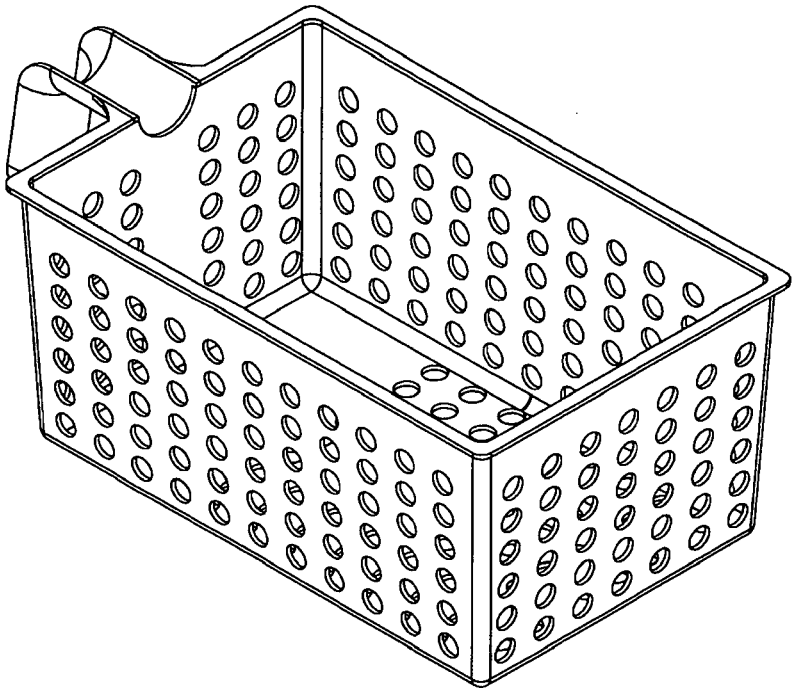
FIG. 02: An isometric view of the washer compartment.
Figure 11:
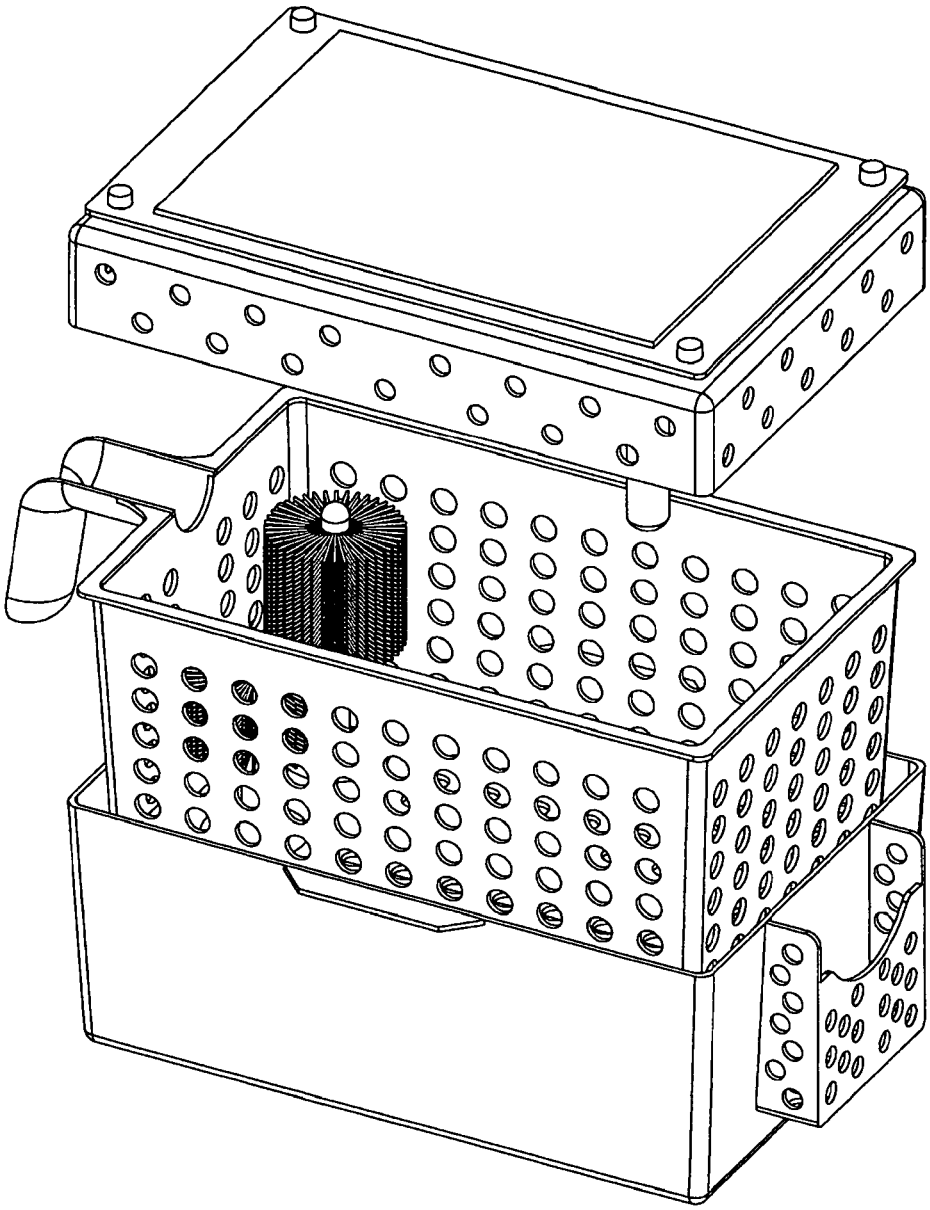
FIG. 11: Front isometric view of the assembled multipurpose appliance—Not including a sample sponge.
Figure 12:
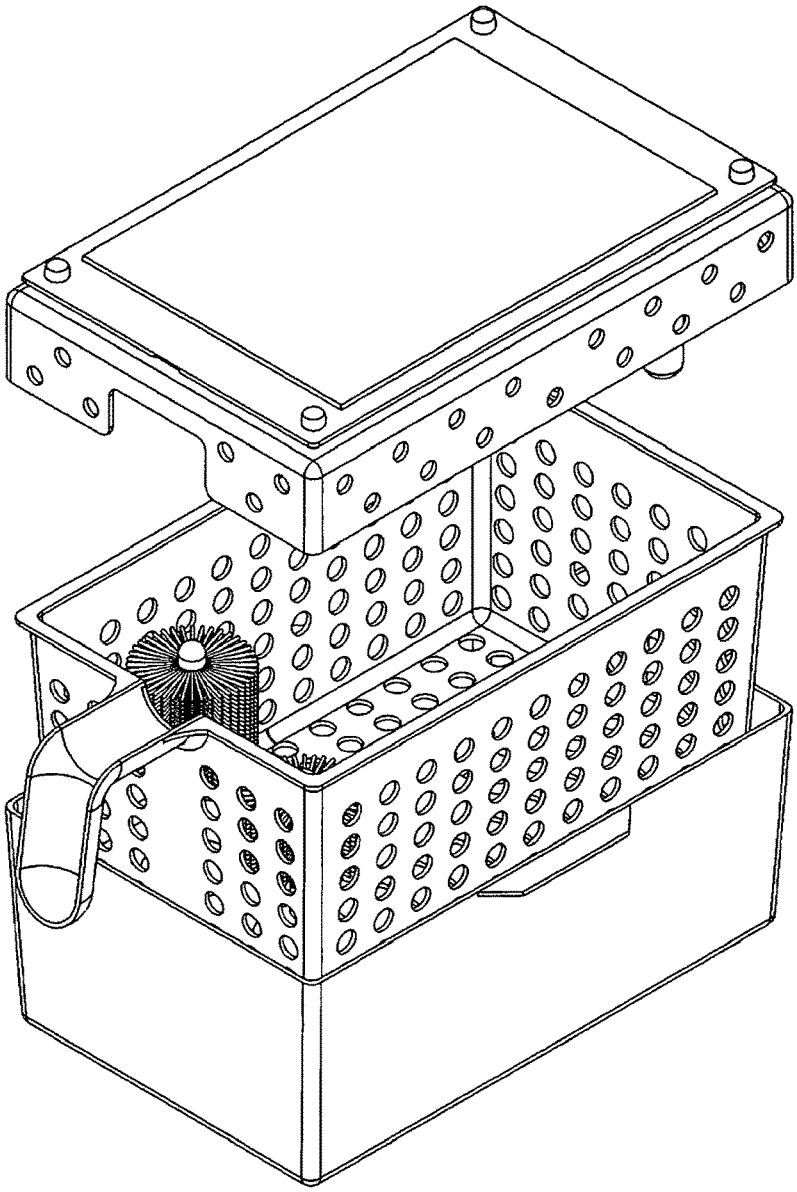
FIG. 12: Rear isometric view of the assembled multipurpose appliance.
Figure 14:
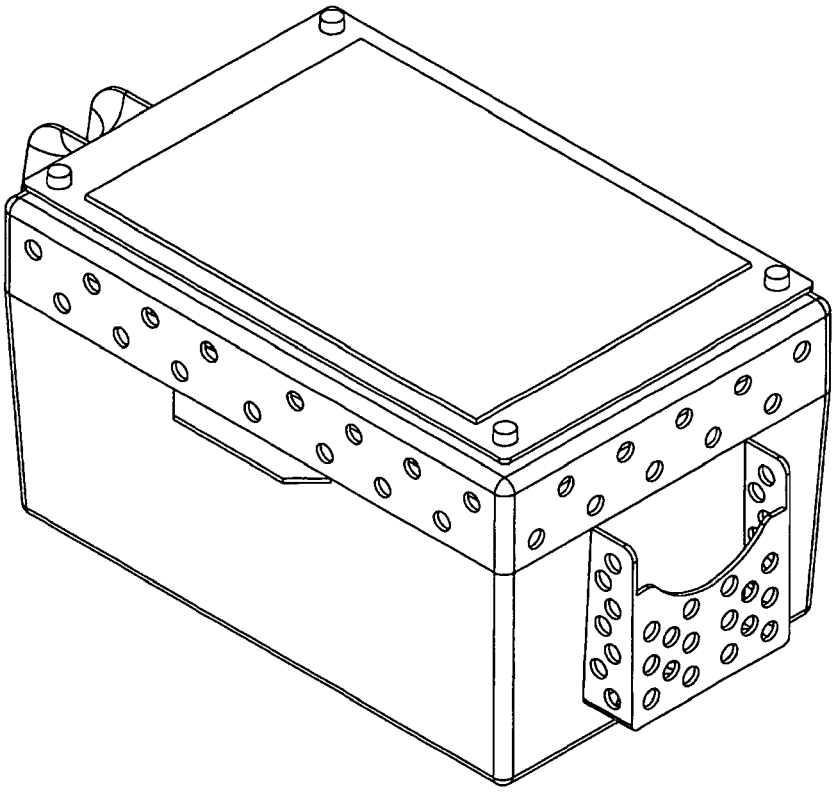
FIG. 14: Front isometric view of the assembled multipurpose appliance.
Figure 15:
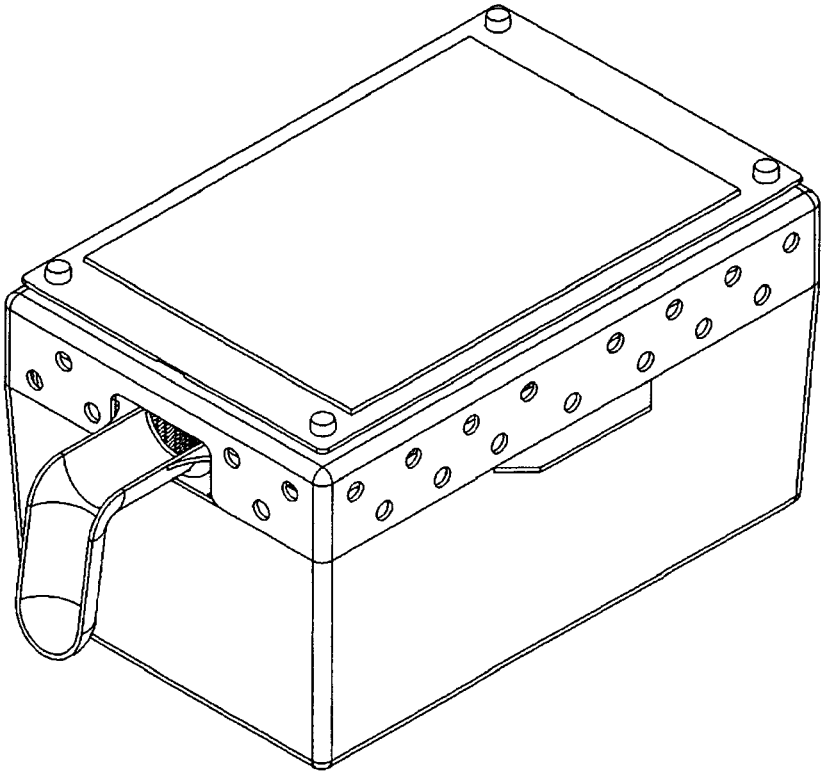
FIG. 15: Rear Isometric view of the assembled multipurpose appliance.

An embodiment of the invention is described with respect to FIG. 11; the full system will provide the user a better and easier experience, great organization and larger product capacity when cleaning individually or simultaneously washable items for baby and/or toddlers.

This product will provide all necessary tools and devices for receiving and transmitting a variety of elements successively, jointly, privately, alternatively and/or simultaneously between its parts for better performance of each stage of the cleaning job and organization (1, 3, 10-11).

In a preferred embodiment, a compartment (1) specially designed for various applications—depending on the preference of the user—It possesses a space specially created to contain several items that need to be stored and cleaned. It has at least one handle for an easier lift and a space to place a cleaning tool; such as a sponge; for the exclusive use of your baby and young children's items. This compartment can be used to help the parent in multiple purposes. It works great as a receiver, organizer and even as a washer (so your home is not crowded of baby stuff laying around all over your house or by the kitchen or sink area).

In a preferred embodiment, a hollowed bucket (FIGS. 2, 3, 4 and 5) with at least one handle to support held or hung such device; it is especially designed for washing multiple items at the same time. Its floor has in one side a flat solid space to put auxiliary cleaners; such as multi-purpose brushes (Ideally, one brush for small items, and the other one for regular sized items; preferably secured by a suction bottom base) (FIG. 6).

This structure helps the user to wash their items in a faster, easier and better manner because it will provide a special structure to wash, and will prevent direct contact with other surfaces, food leftovers, substances and even invisible germs sometimes found in the most unexpected areas.

In a preferred embodiment, a compartment (FIG. 10) exclusively designed to sustain just babies and young children's items of different size, use or type within its structure (FIG. 8) characterized not just for having a plurality of different sized fingers to hang items, but also for the supporting parallel spaces to let dry other small items such as baby/toddler plates, theethers, straws, small forks, etc. The left side has space with grids where other small items such as pacifiers, smaller teethers, caps can be placed to dry. Also the bottom of the rack possess' a drainage area to prevent the countertops from water dripping (FIG. 9) this part is detachable for easier cleaning.

The invention claimed is:

1. A multi-purpose household appliance for storing, washing, drying, and organizing baby bottles and other infant and children's products and elements, the appliance comprising:

a base having sidewalls, a closed bottom, and an open top forming a compartment with an interior;

a wash basket having sidewalls, a bottom, and an open top forming a compartment with an interior, the wash basket shaped to be complementary to the base, the sidewalls and bottom each having a plurality of apertures;

a drying rack having sidewalls, a bottom, and an open top forming a compartment with an interior, the drying rack shaped to be complementary to the base, the sidewalls and bottom each having a plurality of apertures; and a draining board connected to the bottom of the drying rack, wherein the wash basket is configured for nested receipt within the interior of the base and the drying rack is configured to be vertically inverted and coupled with the base to form an enclosure containing the wash basket so that the entire appliance can be stored as a single enclosure, wherein a portion of the bottom of the wash basket is a continuous flat surface without apertures to form a surface for mounting of a brush via a suction system, wherein the drying rack has a plurality of generally cylindrical projections projecting from the bottom of the drying rack into the interior of the drying rack, the plurality of projections comprising a plurality of first projections, a plurality of second projections, and a plurality of third projections, the first projections being longer than the second projections, and the second projections being longer than the third projections, said projections configured to hold baby bottles and other infant and children's products and elements of different shapes and sizes.

2. The appliance of claim 1, wherein the base further comprises at least one gripping handle.

3. The appliance of claim 1, wherein the base further comprises an auxiliary cleaner storage compartment formed on a side wall of the base.

4. The appliance of claim 1, wherein the wash basket further comprises a brush with a suction system configured to attach to the portion of the bottom of the wash basket without apertures.

5. The appliance of claim 1, wherein the wash basket further comprises a handle extending to an exterior of the base when the wash basket is nested within the interior of the base.

6. A method of using the appliance of claim 1, the method comprising:

cleaning a baby bottle or other infant or children's products and elements within the interior of the wash basket, drying the baby bottle or other infant or children's products and elements within the interior of the drying rack or wash basket, and storing the baby bottle or other infant or children's products and elements in the base, wash basket, or drying rack.

* * * * *